United States Patent [19]

Ingouf

[11] 4,267,791

[45] May 19, 1981

[54] JIB ROLLER SYSTEMS

[76] Inventor: Jean-Pierre Ingouf, 131, rue de la Santé, 75013 Paris, France

[21] Appl. No.: 60,611

[22] Filed: Jul. 25, 1979

[30] Foreign Application Priority Data

Aug. 4, 1978 [FR] France ..... 78 23656

[51] Int. Cl.[3] ..... B63H 9/10

[52] U.S. Cl. ..... 114/106

[58] Field of Search ..... 114/102, 104–107

[56] References Cited

U.S. PATENT DOCUMENTS

| | | | |
|---|---|---|---|
| 3,789,790 | 2/1974 | Crall | 114/106 |
| 3,938,460 | 2/1976 | Wales et al. | 114/106 |
| 3,980,036 | 9/1976 | Crall | 114/106 |

*Primary Examiner*—Sherman D. Basinger

*Attorney, Agent, or Firm*—Poms, Smith, Lande & Rose

[57] ABSTRACT

A device for positioning, maintaining, and rolling a headsail on a sailing vessel having a fixed stay adjacent the sail and a halyard for raising the sail includes a tubular mandrel adapted to rotate on the stay. The mandrel is formed by a plurality of mandrel segments about the stay, with each of the segments having three external grooves disposed through an arc of approximately 120 degrees. A normally closed locking mechanism is positioned at the top of the mandrel. A sail attaching member, slidably movable along the mandrel and attached to the top portion of the sail is moved into locking engagement with the locking mechanism by the sail halyard when temporarily connected thereto. A releasing member, which is also slidably movable along the mandrel and attachable to the halyard, releases the sail attaching member from the locking mechanism, thereby allowing the sail to be lowered.

10 Claims, 24 Drawing Figures

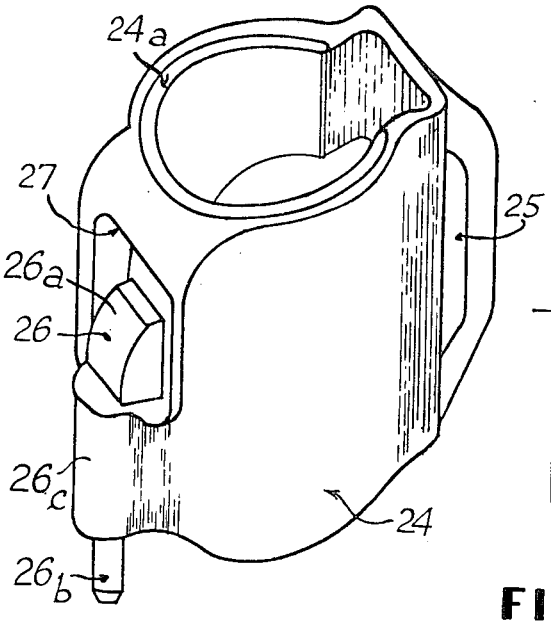
FIG. 12
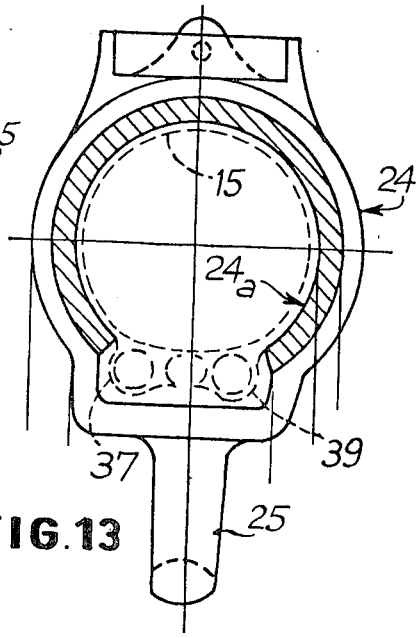
FIG. 13
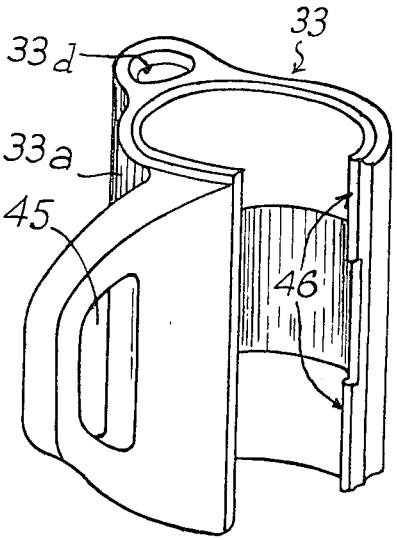
FIG. 14
FIG. 15
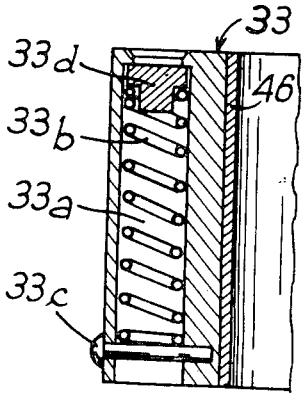

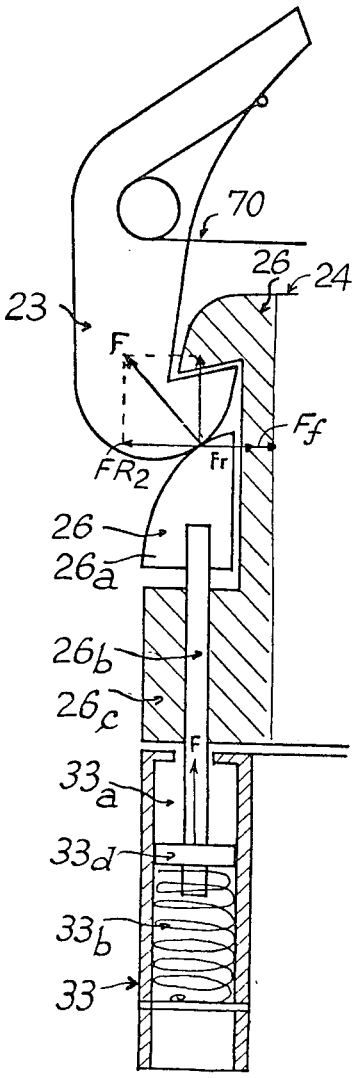
FIG. 18
FIG. 22
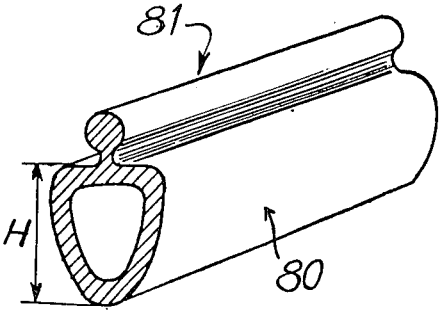
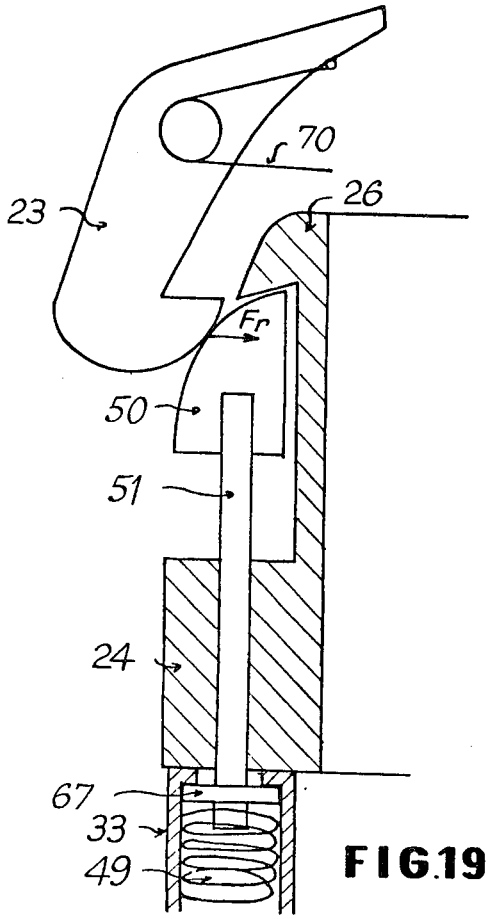
FIG. 19

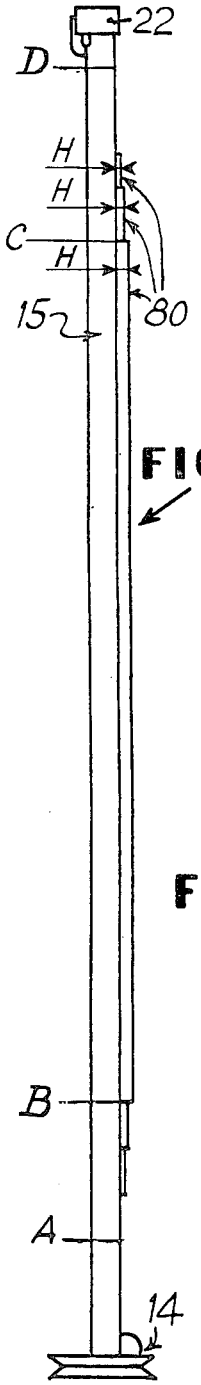
FIG.21
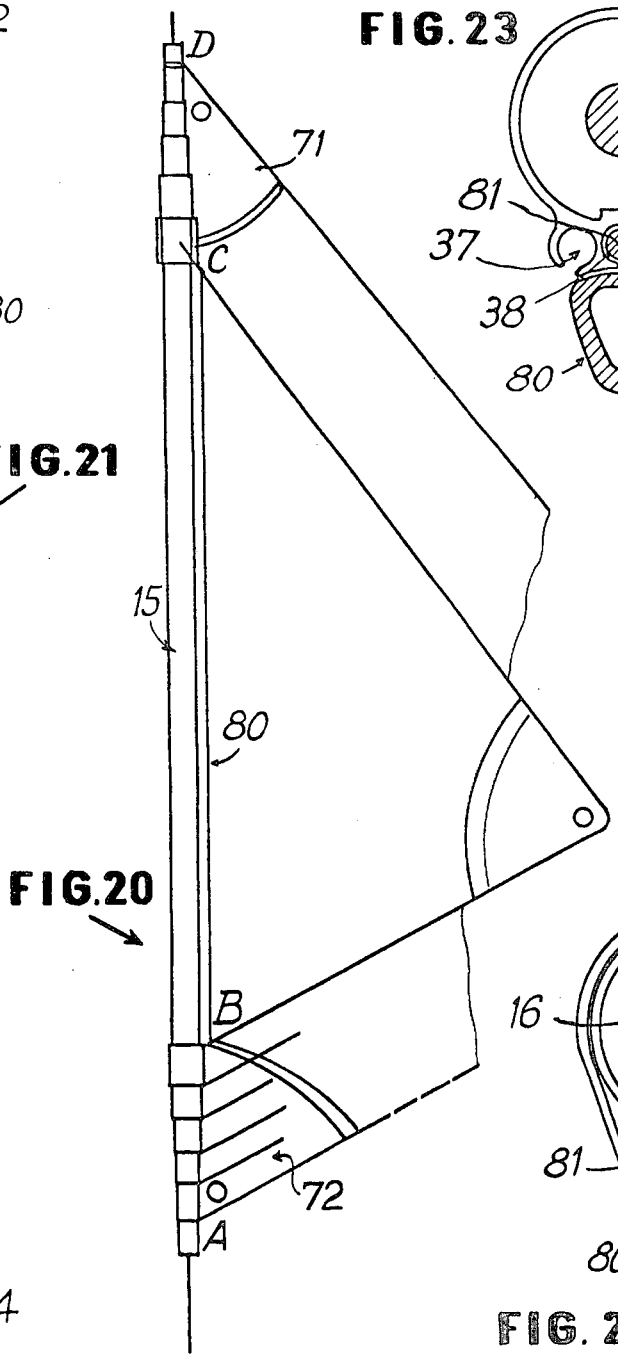
FIG.20
FIG. 23
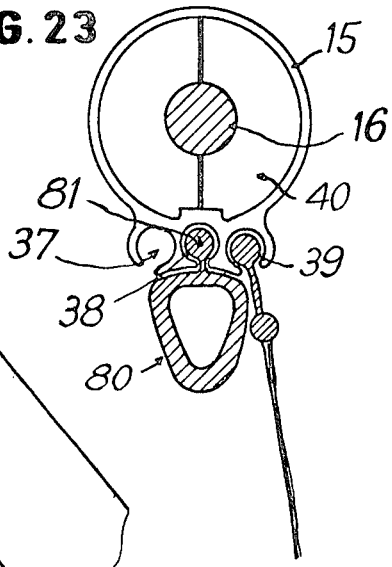
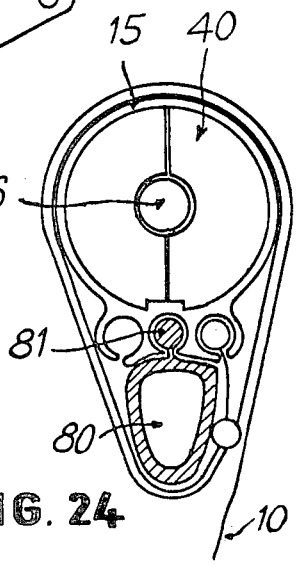
FIG. 24

JIB ROLLER SYSTEMS

FIELD OF THE INVENTION

The present invention relates to an improvement in the devices for setting a sail and more particularly for setting a jib and for adapting the surface of the said sail to the strength of the wind.

BACKGROUND OF THE INVENTION

Generally, a jib or similar is maintained between the deck (tack on the deck) and the top of the most (head) via a stay on which it is mounted (stayed).

In order to reduce the surface of the sails and adapt it to the force of the wind, it is usual to reef the main sail and to change the jibs (front sails set on the forestay) which requires time-consuming and difficult operations.

In order to overcome these drawbacks, it has been proposed to reduce the surface of the sail by taking it up progressively around its foot (rolling boom) or its luff (rolling jib).

For rolling up a jib around its luff so as to modify its surface, use is made of an apparatus known under the name of "jib roller".

In its simplest and oldest form which has been diagrammatically shown in the accompanying FIG. 1, the jib roller is provided at its base with a drum 1 fixed to the tack 2 on the deck by means of a swivel E1 and to the head of the mast 3 by means of a second swivel E2 between which the luff of the jib 5 is hoisted. When pulling the cable 6 of the roller drum 1, the jib 5 rolls up progressively about its luff 4. In a more improved device, the drum 1 and the upper swivel E2 are connected by a rotating stay on which the jib is set (made integral with) with snap hooks.

In more recent systems, the rotating stay is provided with one or two grooves in which the bolt rope of the sail can slide. These grooves can be integral with the rotating stay or can be added by means of a metal or plastic sleeves.

With these groove systems, the jib can be easily removed when not in use.

Various solutions are presently used for hoisting the jib along the rotating stay while leaving to the stay the possibility of being driven in rotation when it is desired to modify the surface of the sail by rolling it up along its luff, when the luff is made integral with the stay.

In an embodiment which is acceptable for small ships but which is inadequate for the hoisting forces required for setting the large size jibs, it is merely sufficient to use a halyard passing on a block placed below the swivel E2 at the top of the rotating stay, the extremity of the halyard, after having hoisted the jib, being fixed to the roller drum integral with the rotating stay.

On large ships however, and as diagrammatically shown in FIG. 2, for hoisting the jib 5, use is generally made of the usual halyards 7 of the ship passing on a block 8 at the top of the mast, the halyards being operated by means of a winch 9 placed at the foot of the mast.

Consequently, in this system, since the halyard 7 is fixed, it must necessarily be connected to the head of the jib by means of a swivel block E3, in order that it does not roll up about the stay. If this embodiment is satisfactory and makes it possible to ensure a good hoisting of the sail while leaving the possibility to reduce the surface thereof by rolling it up about its luff, it requires the use of three swivel devices which must have very high mechanical features since they must support the stress of the front stay, which stress may reach several tons or at least the stress of the luff which, although it is not as high, can nevertheless reach several hundreds of deca-Newtons (dN).

Consequently, in order to operate correctly, these swivels must be fitted with ball bearings, the leaktightness of which remain precarious on the bow of a ship exposed to the splashing of salt water and which very often clog up with the result that the roller device becomes unusable.

SUMMARY OF THE INVENTION

The subject matter of the present invention is precisely a simple, strong and reliable device making it possible to position, maintain in position and roll up a sail, in particular a jib, along its luff, so as to modify the surface thereof, which device overcomes the drawbacks of the previous devices and in particular makes it possible to eliminate the use of delicate and costly ball bearings, while leaving the possibility to use the normal halyards of the ship for hoisting and hauling down the said associated with the said device.

Generally, the device according to the invention for setting, maintaining and rolling up a sail (which device will hereinafter be also designated a "jib roller") is of the type in which the sail is fixed to a mandrel which is adapted to rotate about the fixed stay and which is provided with at least one groove in which can slide the bolt rope, said rotating mandrel being associated with means for driving it in rotation such as a roller drum, in such a manner as to cause a reduction in the surface of the sail by rolling up on the periphery of the mandrel.

The device according to the invention is characterized by the fact that the mandrel (15) is constituted by tubular segments (15*a*–15*b*) fitted in an internal sleeve (34) and defining three external grooves (37 to 39) within a center angle which is less than 120°, that the mandrel is provided at its top with a retractable movable locking device (22) which is normally in the closed position, that the mandrel carries and guides a slide (24) associated with

- means (25) for connection with the sail and temporary connection with a mast halyard,
- static means (27) for engagement with the locking device,
- means (33–26) for opening the retractable locking device.

In a preferred form of embodiment, the device according to the invention is characterized by the fact that the tubular element is provided with three parallel grooves which extend over its entire length, substantially along the generating lines, the apex angle of the sector occupied by the three grooves being less than about one hundred and twenty degrees (120°), and that the external edges of said grooves serving as guiding and maintaining element for a second slide called "release slide" comprising means adapted to cause opening of the retractable locking device and, consequently releasing of the supporting slide, this second slide surrounding to a partial extent the tubular element in such a manner as to leave the grooves apparent and free, and being disposed below the supporting slide and able to be displaced independently from the latter along the tubular element.

Preferably, the tubular element in conformity with the invention is constituted by the fitting of short elements about the existing stay, the rotation of these elements about the stay being advantageously ensured by bearings.

In this embodiment, in particular for obtaining a good rigidity and a perfect alignment between the grooves, the assembly of the short tubular elements is obtained by fitting, each element comprising at one of its ends, a split sleeve, which is inserted by pressing in the preceding element, a rib being provided on an internal generating line of each element, in such a manner as to serve as a guide for the split sleeves.

For ease of assembly, the split sleeves are preferably fixed to the extremity of each tubular element, for example by glueing of any other equivalent means.

Furthermore, it is possible to still improve the rigidity of the assembly by inserting between two consecutive elements in the central groove a cylindrical bolt force-fitted in said groove.

Furthermore, in a variant embodiment, the tubular element can be associated with means making it possible to compensate for the excess thickness which may exist in the sail (reinforcement of the tacks and heads) when rolling it up about the periphery of the mandrel, in such a manner as to constantly obtain, when rolling it up, a strictly plane residual surface. These means may for example consist in a stick fixed to the central groove outside the zone or zones where excess thickness exists in the sail.

The invention and the advantages provided by said invention will however be better understood by virtue of the example of embodiment given hereinafter as an indication and without limitation, which is illustrated in the accompanying drawings.

BRIEF DESCRIPTION OF THE DRAWINGS

FIG. 12 is a perspective view of one of the constitutive elements of the invention, FIG. 13 is a plan view, partly in cross-section, showing the element according to FIG. 12.

FIG. 14 is a perspective view illustrating another constitutive element of the subject of the invention.

FIG. 15 is a partial elevational sectional view of the element according to FIG. 14.

FIGS. 18 and 19 are partial sectional views showing two particular phases of a state of operation of some of the members of the subject of the invention.

FIG. 20 is a diagrammatic view showing a feature of utilization of the invention.

FIG. 21 is an elevational view of a development of the invention.

FIG. 22 is a perspective view showing in greater detail the development according to FIG. 21.

FIGS. 23 and 24 are transverse sectional views showing how to carry into practice the development according to FIG. 21.

DETAILED DESCRIPTION

Figure 1:
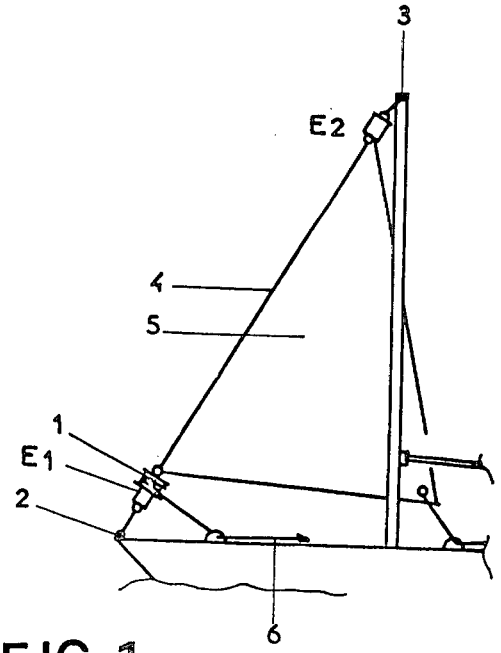
FIG. 1 PRIOR ART
FIGS. 1 and 2 diagrammatically illustrate the state of the prior art examined previously.
Figure 2:
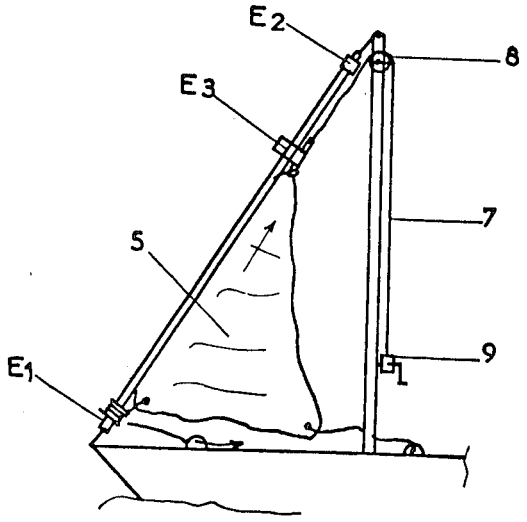
FIG. 2 PRIOR ART
Figures 3, 4:
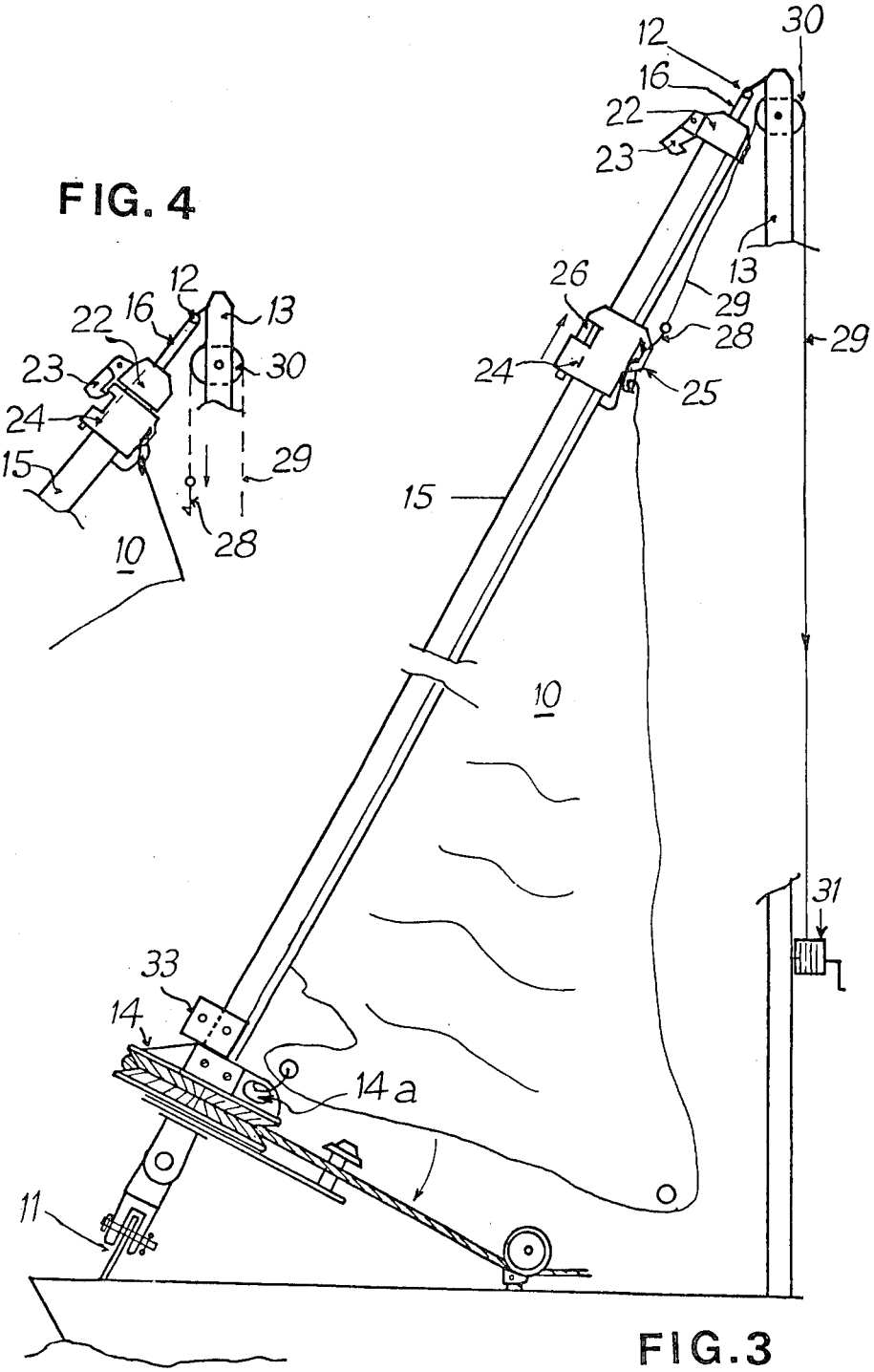
FIGS. 3 and 4 are general views showing a device in accordance with the invention firstly during the positioning of the sail (FIG. 3) and secondly subsequently to this positioning (FIG. 4).

As illustrated in particular in FIGS. 3 and 4, the device according to the invention for positioning, maintaining and rolling up a sail is of the type in which the sail 10 is fixed to the tack 11 on the deck and to the head 12 at the top of the mast 13 via a rotating mandrel having at least one groove, in which can slide the bolt rope of the sail 10;

This rotating mandrel is associated with means making it possible to drive it in rotation, such as a roller drum 14 known per se in order to cause rolling up of the sail 10 about the periphery of the rotating mandrel.

Figure 5:
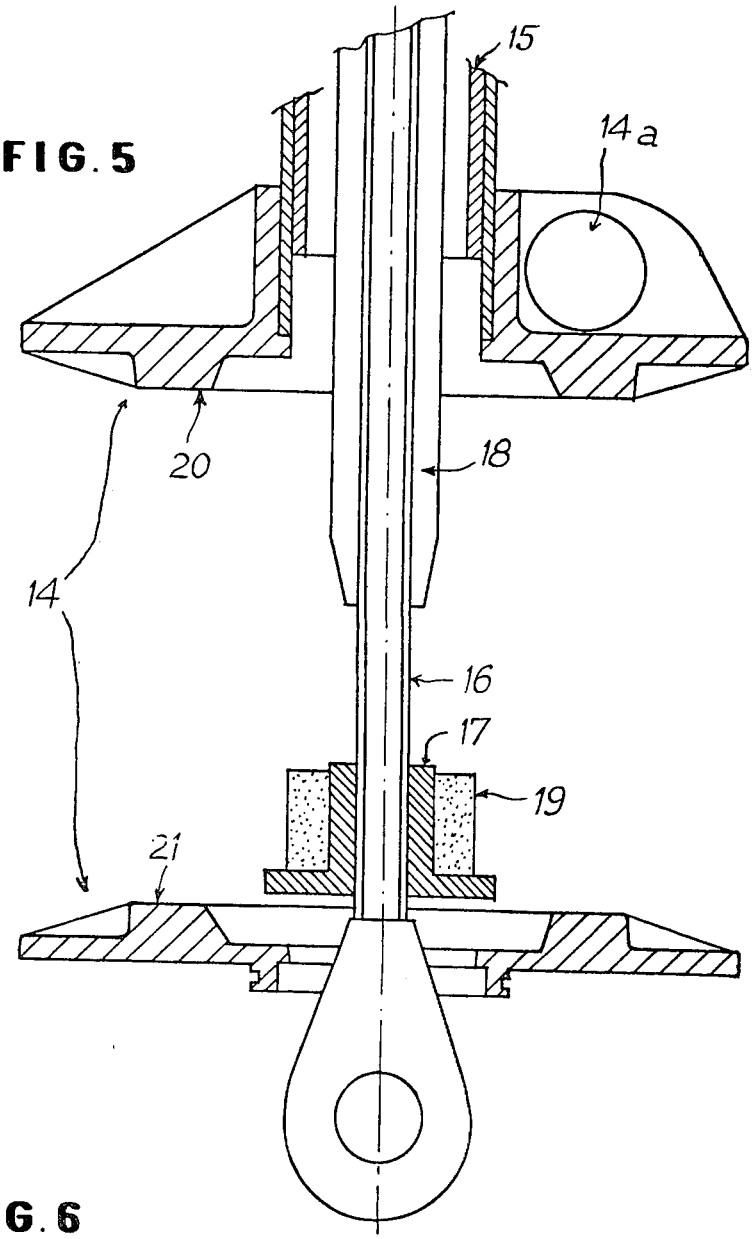
FIG. 5 is a partial sectional view showing more particularly how one of the elements of the invention is mounted on a fixed stay.
Figure 6:
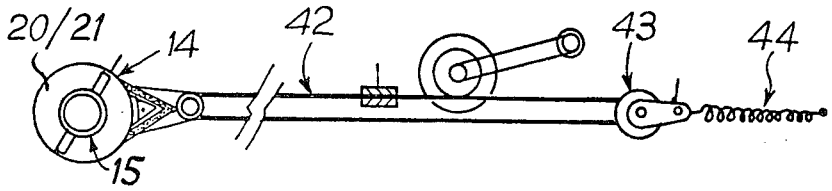
FIGS. 6 through 11 are views showing a form of embodiment of a tubular element forming a rotating mandrel according to the invention.

The rotating mandrel is formed by a tubular rigid element, mounted so as to freely rotate about a fixed co-axial stay connecting the tack 11 on the deck to the head 12 at the top of the mast. The lower part of this tubular member 15 lies on an abutment rigid with the stay 16. As shown in greater detail in FIG. 5, the tubular element 15 is mounted about the co-axial fixed stay 16 and the abutment integral with this fixed stay 16 consists in this embodiment of a bearing 17, for example of stainless steel, integral with the block of the rigging screw 18 and which supports a bearing 19, for example of polyamide, the diameter of which corresponds to the internal diameter of the tubular element 15. Furthermore as can be seen in this FIG. 5, the drum 14 which makes it possible to drive in rotation the tubular element 15 consists of two notched plates 20 and 21, one of which, 20, is carried by the tubular end 15 and the other of which is fixed to the first one. Driving in rotation of the drum 14 is preferably effected by the backward and forward motion of a rope 42 (FIG. 6) maintained under tension by virtue of a reversing block 43 and a resilient stretcher 44 integral with the deck. An embodiment of this type makes it possible to reduce the volume of the driving system.

The upper part of the tubular element 15 is provided with a retractable locking system 22, normally in the closed position and essentially consisting of a hook 23 submitted to the action of a return member.

The tubular element 15 serves as a support and guiding element to a carrying slide 24 comprising:

means for connection with the head of the sail 10, means for engagement with the lock 22 means for temporary connection with the extremity of the halyards passing by the head of the mast.

The tubular element 15 is associated with means for opening the lock 22, these means possibly consisting in a mere return rope. In practice, they are formed by a second slide 33 partly surrounding the tubular element 15 in such a manner as to leave free the grooves of said element, said slide 33 being placed below the carrying slide 24 and being provided with means adapted to cause opening of the retractable locking member 22.

Figure 7:
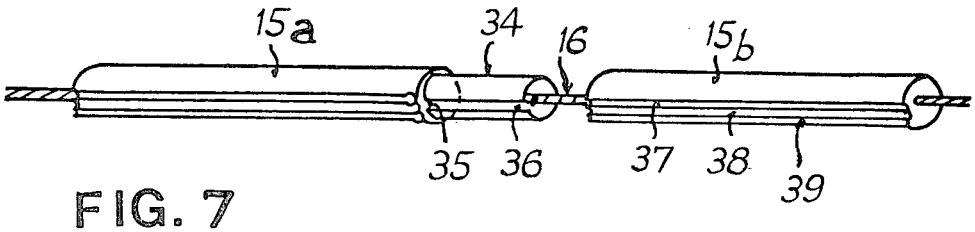
Figure 8:
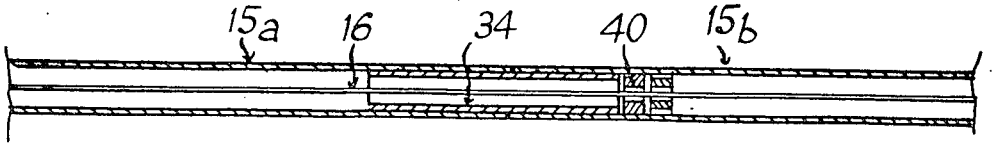
Figure 9:
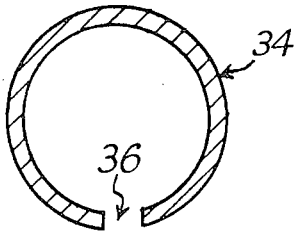
Figure 11:
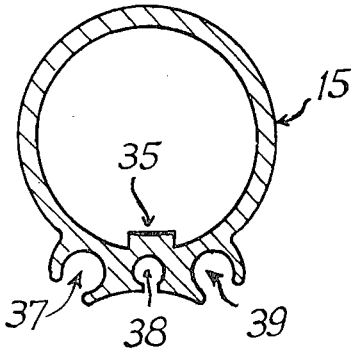

As shown in greater detail in FIGS. 7 and 11, in a preferred embodiment, the tubular element 15 is obtained from short length assemblies **15*a* and 15*b*, fitted one in the other about a fixed stay 16. The joining of these elements to one another is obtained by means of split tubes 34, serving assembly sleeves between the various elements 15***a*–15*b*, these elements comprising a rib 35 the width of which corresponds to the width of the slot 36 of the sleeves 34. An embodiment of this type makes it possible to obtain a perfect alignment of the grooves 37, 38 and 39 of the tubular element 15.

The rotation of the tubular element 15 about the fixed stay 16 is obtained via bearings 40, for example containing polyamide, such as that commercially sold under the trade mark Rilsan (polyamide 11), these bearings not being affected by sea water. The utilization of these bearings is rendered possible by virtue of the invention, by the fact that the tubular element 15 does not support the tension of the front stay kept inside said tubular element 15. Consequently, the bearings 40 have practically no load to support, the lower bearing 19 supporting only the weight of the tube and that of the sail (of the order of a few tens of kilograms).

Figure 10:
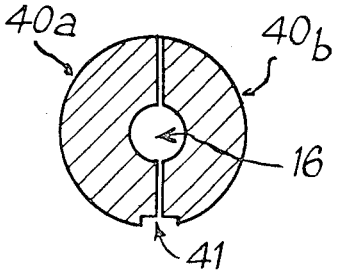

These bearings 40 are advantageously made of two symmetrical parts 40*a*–40*b* (FIG. 10) and defines a groove 41 corresponding to the rib 35 of the tube, which makes it possible to render these elements integral in rotation. The mounting of these bearings is effected by placing them on each side of the stay 16 and urging them inside each element 15*a*–15*b*, in particular by the split sleeve 34.

A form of embodiment of this type makes it possible to obtain a tubular element having a sufficient diameter and a high moment of inertia so as to resist twisting when it is submitted to the torsion torque applied at its foot by the roller drum 14.

With this mounting, it is therefore possible to obtain a tubular element having a hollow cylindrical section, having thin walls, having a diameter of forty (40) millimeters, starting from a light alloy weighing seven hundred and fifty (750) grams per meter and supporting without permanent deformation of 29 m/Kgf (29 m Dn). Furthermore, the fact that the tubular element 15 is obtained from short elements provided with a rib 35 on an internal generating line ensures an accurate guiding of the split sleeves 34 and a lack of clearance in the transmission of the torsion torque from an element to the other, while securing the freedom of longitudinal translation required for a possible disassembling of the elements.

Finally, the tubular element 15 has on its external face three grooves arranged in parallel relation, 37, 38, 39. These grooves extend over the entire length and the apex angle of the sector which they occupy is preferably less than one hundred and twenty (120) degrees. In a known manner, two of these grooves (37 and 39) serve to maintain the bolt rope of the sail 10, the third groove (central groove 38) being a service groove used either for having accessories (assembly rods and oscillating loaders) introduced therein, or circulate therein, or for having available junction members reinforce the connection between these various elements when the tubular element 15 consists of short elements.

The carrying slide 24 shown on a greater scale in FIGS. 12 and 13, is shaped so as to envelope the tubular element 15 on which it is angularly keyed by the external edges of grooves 37 and 39. The guiding of the slide 24 and its free sliding on the tubular element is obtained by one of the fittings or bearings 24*a* added internally and for example made in a material known under the trade mark Rilsan or Teflon. As indicated before, the carrying slide 24 comprises means for connection with the sail, said means consisting in an elongated eye 25 extending axially to the external periphery of the slide 24. The means for engagement with the retractable locking means consist of a catch or cam 27 hanging over a pawl 26 comprising a head 26*a* and a tail 26*b* which is free to slide in a bore in the boss 26*c* extending axially to the external periphery of the slide 24 opposite the eye 25. The tail 26*b* normally projects from the lower peripheric edge of the slide 24. The means for temporary connection with the extremity of a halyard are preferably constituted by the same eye 25 but it can be envisaged that the slide 24 be provided with an eye suitable for this function.

The slide 33, hereinafter called releasing slide, and as shown in FIGS. 14 and 15 is formed by an axially opened envelope in such a manner that it can be threaded on the tubular element 15 while clearing the grooves 37 to 39. The axial opening of the envelope is selected in such a manner that the edges cooperate with the flanges of the extreme grooves 37 and 39 which therefore ensure angular immobilization thereof. The releasing slide 33 is provided, opposite its axial opening, with a cylindrical opening 33*a* in which is placed a spring 33*b* which is held in a compressed state between a stop 33*c* and a head 33*d*. The slide 33 is also provided, starting from its external periphery, with an eye 45 extending axially, while being located in one of the sectors comprised between the boss 33*a* and the axial opening. As for slide 24 provision is made for providing the open internal periphery of the releasing slide 33 with rings or bearings 46.

The positioning, the maintenance or the possible rolling up of the sail about the tubular member 15 forming rotating mandrel are effected in the following manner.

The tack of the sail, in the present position of the jib, is necessarily applied to an eye 14*a* of the winding block 14, its head being fixed to the eye 25 of the carrying slide 24 guided on the tube 15.

Figures 16, 17:
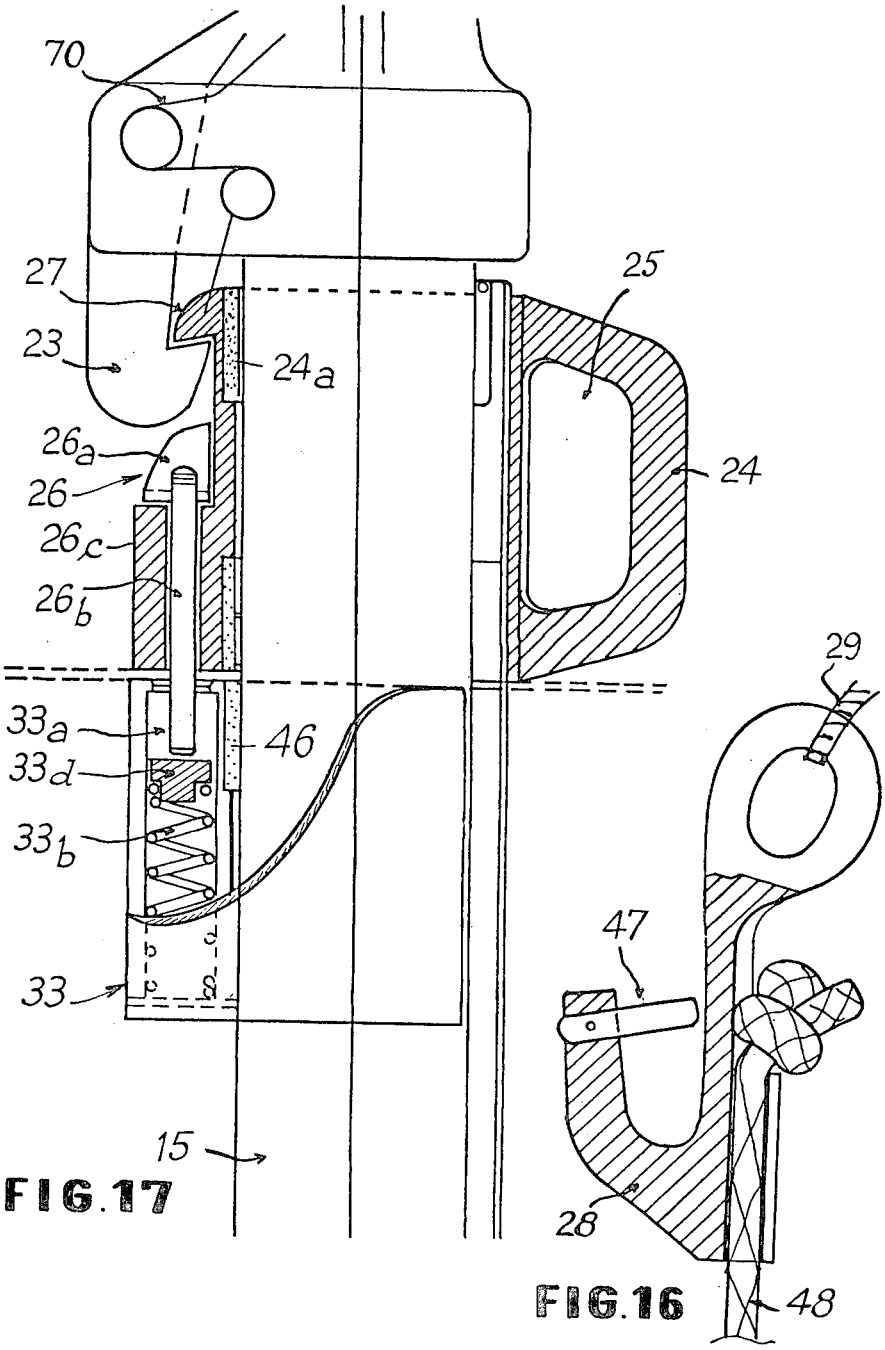
FIG. 16 is a sectional view showing a member of the subject of the invention.
FIG. 17 is an elevational sectional view showing the subject of the invention in a particular state of operation.

For hoisting up the jib, use is made of a halyard 29 passing around a block 30 placed at the head of the mast and ending to the winch 31 (FIG. 3). The connection between the slide 24 and the halyard 29 is established via a hook 28 provided at the end of the halyard and appearing, as illustrated in FIG. 16, under an opened form, closed by a gate 47, containing for example elastomers, sufficiently stiff for avoiding the said hook to slip away under the influence of its weight, but allowing it to be disengaged by a pull exercised in a return rope fixed to the foot of the mast. By acting on the winch 31, the slide 24 is lifted along the tubular element 15 and therefore the jib rises. At the end of the operation, the cam 27 of the slide 24 is engaged at the top of the tubular element 15, below the retractable locking device 22 and more particularly below the hook 23 normally maintained in the closed position, for example by a spring 70. After engagement, (FIG. 17) the tension of the halyard 29 can be released since, by virtue of the hook 23, the hoisting tension of the luff is then supported by the tubular element 15 (FIG. 4). A traction on the return rope 48 releases the opened hook 28 of the slide and makes it possible to bring back the halyard to the foot of the mast. The halyard 29 which is completely free from the tubular element supporting the sail, is therefore available for another use.

For hauling down the jib, the halyard 29 is this time fixed by its hook 28 to the eye 45 of the releasing slide 33 stocked at the base of the tubular element 15.

The releasing slide 33 is lifted along the tubular element 15 via halyard 29, until it comes into contact with the carrying slide 24 (FIG. 17). In this position the head 33*d* collides with the tail 26*c* which pushes back the head in the housing 33*a* with the result that it compresses spring 33*b*. When the contact is established between the edges opposite the superposed slides, a supplementary effort on the halyard relieves the strain on slide 24 and therefore frees the head of the hook 23 from the tension of the luff, which makes it possible for the pawl 26, which is pushed upwards by the action of spring 33*b* on the rod 26*b*, to penetrate under the hook 23, to cause it to rotate, and then to release the cam 27 of slide 24, which starts right away its downward movement, as soon as the halyard 29 is completely released.

As shown in greater details in FIGS. 18 and 19, the opening of the hook 23 takes place in fact very rapidly, as soon as the component $FR_2$ of the compression force F of the spring 33*b* becomes equal to the sum Fr+Ff of the compression forces due to the spring 70 of the hook 23 (Fr) and to friction forces (Fr). Since the friction force in motion is much less than Ff, the opening which is started accelerates until complete release at a moment when the traction of the halyard is still less than the traction of the luff supported up to now by hoock 23.

Consequently, at the very moment where the hoock 23 escapes from cam 27, the halyard 29 is urged downwards by an increased force due to the entire tension of the luff. It is therefore elongated when the downward movement of slide 24 is started, which is an ideal condition for a clear and non-reversible release.

Furthermore, the device according to the invention can be easily adapted to obtain a good flatness of the sail when it is rolled up to a partial extent about the tubular element 15, in spite of the excess thickness which it can exhibit, in particular at its end parts.

As a matter of fact, it is current use to reinforce the tacks and heads by means of a plurality of superposed layers of fabric 71–72 (FIG. 20). The number of these layers often reaches five to seven. If it is admitted that the thickness of the fabric is about 0.5 mm, this means that the thickness of the reinforced zone may be 3 mm.

If use is made of a tubular element 15 having a perimeter p=140 mm, the diameter of the second revolution rolled up on the first one will be increased by 2×3 mm and the perimeter will be 140 mm+($\pi\times6$)≠140+18 mm and so forth.

If it is admitted that the reinforced zone is completely rolled up on five revolutions, as shown in FIG. 20, the length rolled up on the reinforcement zone after these five revolutions will be:

| | |
|---|---|
| 1st revolution | P1 = 140 |
| 2nd revolution | P2 = 140 + 18 |
| 3rd revolution | P3 = 140 + 36 |
| 4th revolution | P4 = 140 + 54 |
| 5th revolution | P5 = 140 + 72 |
| TOTAL | PR = 700 + 180 = 880 mm |

But outside the reinforcement zone, the length of the fabric rolled up by these five revolutions will be respectively:

| | |
|---|---|
| 1st revolution | P1 = 140 |
| 2nd revolution | P2 = 140 + 3 |
| 3rd revolution | P3 = 140 + 6 |
| 4th revolution | P4 = 140 + 9 |
| 5th revolution | P5 = 140 + 12 |
| TOTAL | Ph = 700 + 30 = 730 mm |

Rolling up in the central zone of the sail outside the reinforcement zone will therefore show a difference of 880−730=150 mm. This difference generates folds and an excessive deepening in the sail.

The remedy to this drawback consists in increasing by an artificial means the rolling up perimeter in the zone BC comprised between the reinforcements (FIG. 20, 21).

In the preceding example, a uniform increase of 30 mm of the perimeter of the mandrel 15 in the zone BC exactly compensated the difference due to the reinforcements of the ends of zones AB and CD.

Besides the fact that the construction of a rolling up tubular element with progressive sections raises technical problems, it is not to be recommended, since the shape of the mandrel 15 should be adapted to each particular sail, regarding both the distance BC and the excess thickness of this reinforced zone.

The tubular element according to the invention on the contrary brings a universal solution to this problem. It consists in creating a rolling up mandrel tube with constant profile by forming the increase of the desired perimeter by application along a generating line of the mandrel 15, of an added element, such as a stick 80, of plastic material or similar. To this end, use can be made of an element such as shown in FIGS. 22 to 24, consisting of a stick 80 of light alloy or plastic material, comprising a stud 81 which can be inserted in the central groove 38 of the tubular element 15. The joining together of the stick 80 with the tubular element 15 can be obtained by glueing, riveting or any other equivalent means. It is therefore possible, when using sticks 80 having different heights, to adapt the excess thickness due to the sticks to all the possible sail structures, if the shape of the reinforcements or the initial deepening of the sail requires it. (cf. FIG. 21).

Obviously, when the tubular element is constituted of an assembly of short elements, the stick 80 can be cut into elements of similar size in order to be pre-assembled on the portions of tubular elements intended to be fitted in one another.

POSSIBILITIES OF APPLICATION

The subject matter of the invention is particularly intended for sailing ships and/or competition sailing ships, since it makes it possible to establish simultaneously double foresails which operate in a manner similar to a Spinnaker and the surface of which can be adjusted if necessary by rotation of the tubular element 15.

What is claimed is:

1. A device for positioning, maintaining, and rolling a headsail on a sailing vessel having a fixed stay adjacent said sail and a halyard for raising said sail, comprising:
   - (i) tubular mandrel means adapted to rotate on said stay comprising:
     - a. a plurality of mandrel segments placed end to end along said stay, said segments having an internal bore for receiving said stay and three external grooves disposed through an arc of not more than 120 degrees with respect to said internal bore;
     - b. internal sleeve means for interconnecting said segments;
   - (ii) normally closed locking means disposed at the top of said mandrel means;
   - (iii) sail attaching means, slidably movable along said mandrel means and attached to the top portion of said sail, for moving into locking engagement with said licking means, said sail attaching means being temporarily connectable with said halyard; and (iv) releasing means, slidably movable along said mandrel means and attachable to said halyard, for releasing said sail attaching means from said locking means, thereby allowing said sail to be lowered.

2. A device according to claim 1, wherein:

said internal sleeve means comprises a plurality of internal sleeves split longitudinally in order to cooperate with internal axial ribs of said mandrel segments, said sleeve means including internal bearing means having two independent parts and insertable inside said mandrel segments for centering said sleeve means on said stay.

3. A device according to claim 2, wherein said device further comprises:

cylindrical assembly rods disposed in one of said three external grooves of said mandrel segments for assisting in connecting said segments.

4. A device according to claim 1, wherein said locking means comprises:

a hook;

spring means to maintain said hook in a closed position.

5. A device according to claim 1, wherein said device further comprises:

stick means, insertable into one of said three external grooves for compensating for the excess thickness of said sail when said sail is furled around said device.

6. A device according to claim 1, wherein said sail attaching means includes eye means for connecting to said sail and to said halyard.

7. A device according to claims 1 or 6, wherein said sail attaching means includes a cam projecting therefrom for locking engagement with said locking means.

8. A device according to claim 7, wherein said releasing means comprises:

an open body member positioned upon said mandrel means; and a head portion on said body having resilient means for urging said cam out of locking engagement with said locking means as soon as said releasing means is positioned below said sail attaching means when said sail attaching means is in locking engagement with said locking means.

9. A device according to claim 8, wherein said releasing means further comprises:

an eye member connectable to said halyard.

10. A device according to claim 1, wherein said device further comprises:

a bearing attached to the bottom of said stay;

a drum surrounding said bearing and positioned adjacent the decking of said vessel, said drum having a groove in the shape of a "V";

a rope wound into said drum, whereby said sail is furled around said mandrel by pulling said rope; and means for maintaining tension on said rope to prevent unwanted furling of said sail.

* * * * *